United States Patent [19]

Leung et al.

[11] Patent Number: 5,039,227

[45] Date of Patent: Aug. 13, 1991

[54] MIXER CIRCUIT FOR OIL SAND

[75] Inventors: Anthony H. S. Leung, Sherwood Park; George J. Cymerman; Waldemar B. Maciejewski, both of Edmonton, all of Canada

[73] Assignees: Alberta Energy Company Ltd.; Canadian Occidental Petroleum Ltd.; Esso Resources Canada Limited, all of Calgary; Gulf Canada Resources Limited, Toronto; Her Majesty the Queen in the right of the Province of Alberta, Edmonton; HBOG-Oil Sands Limited Partnership, Calgary; PanCanadian Petroleum Limited, Calgary; Petro-Canada Inc., Calgary, all of Canada

[21] Appl. No.: 440,927

[22] Filed: Nov. 24, 1989

[51] Int. Cl.[5] ..... B01F 15/02

[52] U.S. Cl. ..... 366/137; 366/136; 366/165; 366/348

[58] Field of Search ..... 366/3, 10, 40, 96, 131, 366/132, 136, 137, 159, 165, 167, 341, 348, 173; 137/896; 406/181, 19; 422/234, 235

[56] References Cited

U.S. PATENT DOCUMENTS

| | | | |
|---|---|---|---|
| 1,062,307 | 5/1913 | Stobie | 366/165 |
| 3,661,364 | 5/1972 | Lage | 366/159 |
| 4,007,921 | 2/1977 | Zingg | 366/136 |
| 4,130,365 | 12/1978 | Sittig | 366/137 |
| 4,498,819 | 2/1985 | El-Saie | 137/896 |
| 4,534,655 | 8/1985 | King et al. | 366/165 |
| 4,818,499 | 4/1989 | Chantriaux et al. | 422/234 |
| 4,857,355 | 8/1989 | Gregg | 366/136 |
| 4,863,277 | 9/1989 | Neal et al. | 366/137 |

*Primary Examiner*—Timothy F. Simone
*Attorney, Agent, or Firm*—Millen, White & Zelano

[57] ABSTRACT

The mixer circuit comprises a vertically oriented, open-topped mixer vessel having a cylindrical side wall terminating with a shallow conical bottom. The bottom wall forms a central bottom outlet. Recycled slurry and fresh water streams are fed tangentially to the inner surface of the vessel, thereby forming a vortex. The oil sand enters as a continuous, free-flowing stream moving along a downward trajectory; the stream impinges the vortex, wherein it is dispersed and mixed to create slurry. The slurry exits through the bottom outlet, is screened to remove oversize material, and enters a holding vessel. Part of the slurry in the holding vessel is recycled to the mixer vessel through a pipe loop incorporating a pump. The slurry is energized by the pump and functions to maintain and partly create the rapidly moving vortex that carries out the mixing and lump-disintegration actions. The balance of the slurry in the holding vessel is pumped out as product. The circuit is adapted to consistently produce a dense slurry.

7 Claims, 1 Drawing Sheet

MIXER CIRCUIT FOR OIL SAND

FIELD OF THE INVENTION

This invention relates to a circuit for mixing oil sand in hot water to produce a slurry suitable for conveyance in a pipeline.

BACKGROUND OF THE INVENTION

The invention has been developed in connection with mixing oil sand in hot water. While not limited to that application, it will now be described in connection therewith.

Bitumen, a heavy oil, is currently being extracted on a commercial basis from oil sand. Presently, two very large scale commercial operations are producing synthetic crude oil from oil sand in the Fort McMurray district of Northern Alberta.

At each of these operations, the oil sand is stripmined and conveyed on conveyor belts, often several kilometers in length, to an extraction plant. At the extraction plant, the bitumen is separated from the solids and recovered. This is accomplished using a process known as the 'hot water process'.

The hot water process involves mixing the oil sand with hot water (95° C.) and a small amount of caustic in a rotating horizontal drum (or 'tumbler'). Steam is added to the mixture as it moves through the tumbler, to ensure that its exit temperature is about 80° C. In the tumbler, the bitumen is separated from the solids, lumps of the cohesive oil sand are ablated and disintegrated and minute flecks of freed oil coalesce to form larger globules. The term "conditioning" is used to denote the sum of the mechanisms occurring in the tumbler. On leaving the tumbler, the slurry is diluted with additional hot water and retained under quiescent conditions for a prolonged period in a thickener-like vessel referred to as a primary separation vessel ("PSV"). In the PSV, the bitumen globules attach to and film around bubbles of air entrained in the slurry and rise to form froth on the surface of the vessel contents. This froth is recovered. A dragstream is withdrawn from the central part of the PSV and this dragstream is processed in a bank of subaerated flotation cells to produce a secondary yield of bitumen froth. The froth streams are combined and further processed to remove entrained water and solids and yield essentially pure bitumen.

Now, the belt conveyors are characterized by a number of problems. They are expensive to install, operate and maintain And their use requires that the solids, which have no value, must be conveyed to the extraction plant and then returned by truck to the mine pits for disposal. In addition, the tumblers cannot be increased in size to permit of improvement of the system. They are presently so large that it would be technically difficult to manufacture them in a larger size and convey them to the plant site. As a result, it is difficult to reduce the heat requirements of the process by lowering the slurry temperature, because such a step would require increasing the tumbler retention time, which would necessitate larger tumblers.

In a co-pending application, applicants teach use of a pipeline to convey an aqueous slurry of the oil sands from the mine site to the extraction plant. The pipelined slurry may be fed directly to the PSV, thereby eliminating the need for the tumbler. The invention in the co-pending application is based on the discovery that the slurry will undergo adequate conditioning in the pipeline over a distance that is significantly shorter than the length of pipeline needed to get it to the extraction plant. In addition, the slurry will not be over-conditioned if it continues to move through the pipeline after conditioning is complete. (Conditioning is considered to be complete if good bitumen recovery in the form of good quality froth can be achieved in the downstream PSV). This pipeline scheme has the further advantage that most of the coarse solids may be removed in a settler positioned part way along the length of the pipeline.

So pipelining of the oil sand in slurry form between the mine and the PSV is now considered by applicants to be a viable procedure.

The present invention is directed toward providing a mixer circuit which satisfactorily blends the oil sand with hot water to yield a consistent, dense (e.g. about 60%-65% by weight solids) slurry, preferably having a relatively low temperature (e.g. 50° C.), that is amenable to pipeline conveyance.

In this connection, it needs to be appreciated that oil sand is tacky, cohesive, erosive material incorporating a significant content of "oversize". Oversize is a term applied to the rocks, oil sand lumps, and clay lumps that occur in oil sand (often up to a size of 20 inches).

If one were to feed a stream of oil sand into a tank containing hot water and proceed to withdraw a mixture from the base of the tank with a pump, the oil sand would simply pile up in the tank, fill it, and plug the pump. So a mixer circuit for this purpose must be capable of suspending the oil sand in the water with which it is mixed.

It has been mentioned that it is desirable to produce a dense slurry. This need arises from the fact that one wants to minimize the amount of hot water supplied at the mine site for this purpose. Heating water is expensive and there are many reasons why these plants need to conserve water to the maximum.

And of course the mixer circuit has to be capable of coping with the oversize material. Equipment having moving parts, such as a tank equipped with paddle mixers, would be inappropriate for use with the erosive sand associated with oversize chunks.

SUMMARY OF THE INVENTION

In accordance with the invention, as-mined but preferably pre-sized oil sand is mixed with streams of recycled slurry and fresh hot water in the cylindrical chamber of a vertically oriented, open-topped mixer vessel, to produce a slurry. The slurry exits the mixing chamber through a centrally positioned bottom outlet and is screened to remove oversize, thereafter entering the chamber of a holding vessel. Part of the slurry moving through the holding vessel is recycled, to provide the previously mentioned recycled slurry stream entering the mixer vessel. This is done by pumping it through a pipe loop that communicates with the mixing chamber through an inlet that feeds the slurry tangentially to the inner surface of the mixer vessel wall.

The recycled slurry is therefore controllably and mechanically given energy by the pump in the recycle loop. Due to its tangential entry into the mixing chamber, the slurry adopts the form of a rotating vortex, into which the oil sand and fresh water are added. The oil sand is fed into the vortex as a free-flowing stream that moves along a downwardly extending trajectory. The trajectory is directed to cause the stream of oil sand to impinge and enter the vortex adjacent the latter's upper end. The added oil sand and fresh water mix with the rotating recycled slurry to produce a satisfactorily consistent, dense slurry leaving the mixer vessel through its bottom outlet. The intensity of the vortex can be varied by adjusting the output of the recycle loop pump.

In a preferred feature, the fresh water stream is injected into the mixing chamber tangentially to the inner surface of the mixer vessel wall. This incrementally increases the energy supplied to the vortex, although the main energy contributor remains the dense, pumped, recycled slurry.

The proportion of the slurry, produced by the mixer vessel, which is recycled is quite large. The rate of recirculation is maintained so as to ensure that the vortex is capable of accepting and suspending the dry oil sand. Typically the rate of recirculation is 2 to 3 times the discharged slurry rate.

The mixer circuit is characterized by the following features:

the mixer vessel's upright circular bounding surface of relatively small diameter is coupled with a pumped, dense, tangentially-directed recycle stream to create a relatively thick and fast-moving vortex that has been found to be capable of dispersing and suspending the dry oil sand while only about 35 to 40% by weight fresh water is consumed in creating the slurry;

the recycle loop, having a pump, is used to contribute most of the energy needed to carry out the mixing function;

the screen is provided between the two vessels to remove the oversize, so that recycle and product pumping can be accomplished; and the mixer vessel does not incorporate moving parts and can accommodate the passage therethrough of the oversize.

DESCRIPTION OF THE PREFERRED EMBODIMENT

Figure 1:
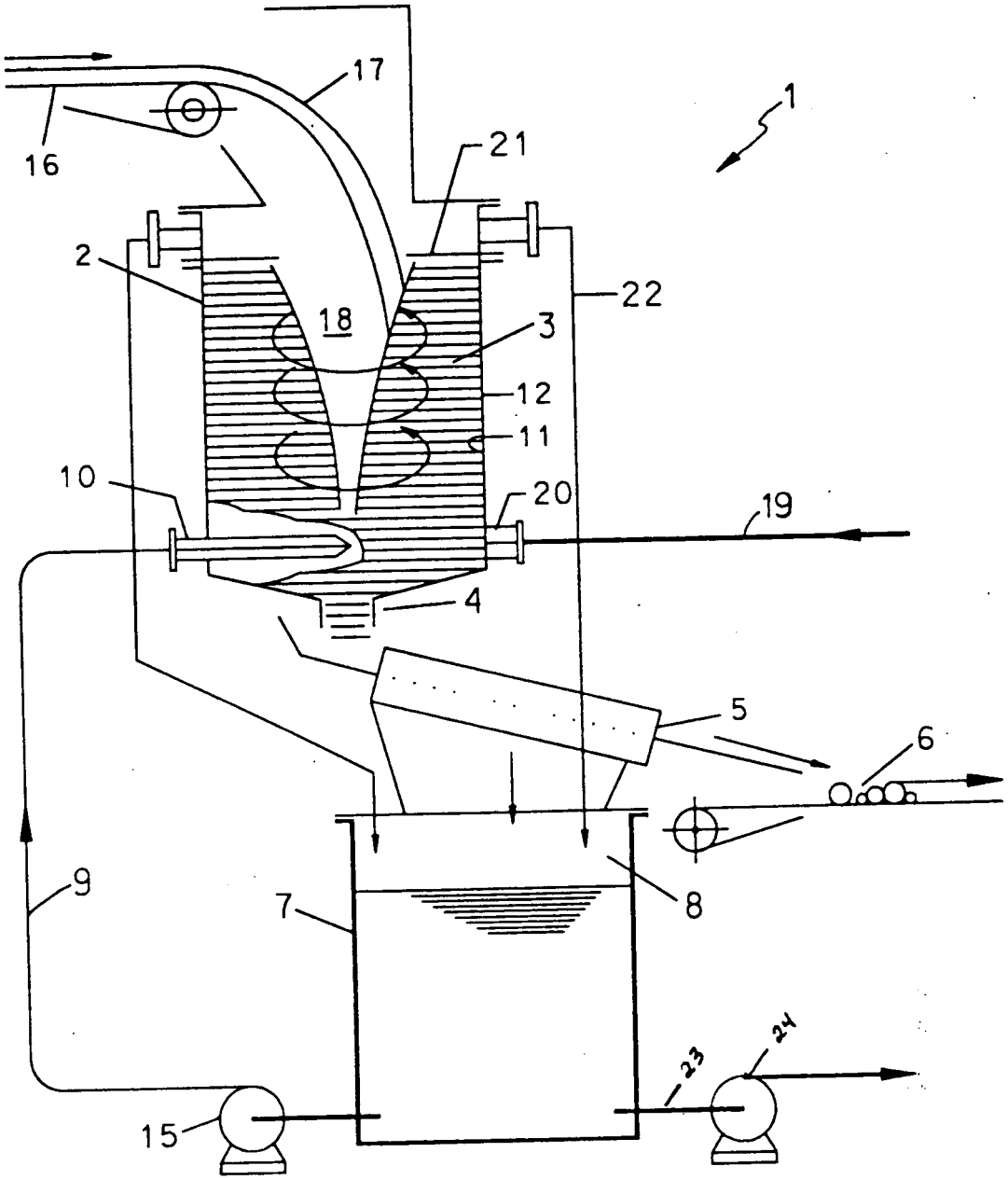
FIG. 1 is a schematic sectional side view of the mixer circuit.

The mixer circuit 1 comprises a vertically orientated mixer vessel 2 forming a cylindrical, open-topped mixing chamber 3. The mixer vessel 2 has a conical bottom which forms a centrally positioned bottom outlet 4.

A vibrating screen 5 is positioned beneath the outlet 4, to retain and reject oversize material 6 unsuitable for subsequent pumping.

A holding vessel 7, forming an open-topped chamber 8, is positioned beneath the screen 5, to receive the slurry passing through the latter.

A recycle pipe loop 9 connects the holding vessel chamber 8 with the mixing chamber 3. The loop 9 connects with an inlet port 10 adapted to feed recycled slurry tangentially to the lower end of the inside surface 11 of the mixer vessel wall 12.

A variable pump 15 is connected into the recycle loop 9, for pumping slurry from the holding vessel chamber 8 into the mixing chamber 3.

A conveyor 16 is provided to feed oil sand 17 from a point spaced to one side of the vertical axis of mixer vessel 2. The oil sand forms a free-falling stream that follows a downward and lateral trajectory and penetrates into the slurry vortex 18, which has been formed by pumping slurry through the inlet port 10 and into the mixing chamber 3.

A line 19, connected with a source (not shown) of hot water, is connected with a port 20 adapted to feed the water tangentially to the mixer vessel inner surface 11.

In practice, the rate at which the oil sand is fed to the mixer vessel 1 tends to be irregular. As a result, the swirling vortex 18 can overflow the rim of the vessel. To cope with this problem, an inwardly projecting flange 21 is provided around the rim, to serve as an annular dam. If slurry rises about the dam, an overflow conduit 22 is provided to drain it into the holding vessel chamber 8.

A line 23 and pump 24 outlet withdraw product slurry from the holding vessel 7, for conveyance to the pipeline (not shown).

The operation and performance of the mixer circuit 1 are exemplified by the following test results from a pilot run using the circuit.

EXAMPLE

A mixer circuit in accordance with FIG. 1 was tested in the field. The cylindrical section of the mixer vessel had a 4 foot diameter and 4 foot height, with a 15° conical section at its base. A 12 inch bottom outlet was provided. A vibrating screen was positioned beneath the outlet, for rejecting plus 1 inch material.

Oil sand, pre-crushed to −5 inches, was introduced at 90 tons./hour and mixed with fresh hot water (90° C.), added at the rate of 360 gallons/minute, and recycled slurry. The slurry was recycled at a rate sufficient to maintain the vortex.

The product from the holding vessel had a density of about 1.6 (about 60% by weight solids) and temperature of about 50° C. The density was consistently maintained within 10% for a period of more than 2 hours.

The embodiments of the invention in which an exclusive property or privilege is claimed are defined as follows:

1. A mixing circuit for slurrying oil sand in water, comprising:

a vertically oriented open-topped mixer vessel forming a circular mixing chamber, said vessel having a centrally positioned bottom outlet leading from the chamber;

means for feeding a free-falling stream of oil sand into the upper end of the mixing chamber;

means for introducing heated fresh water into the mixing chamber;

an open screen for screening the freely discharged slurry stream leaving the bottom outlet, to remove oversize solids;

an open-topped holding vessel for receiving the screened slurry and providing positive suction to an output pump; and a pipe loop, incorporating a pump, connecting the holding vessel with the mixing chamber, said loop being adapted to feed recycled slurry, passing therethrough, tangentially to the inner surface of the mixer vessel wall to form a slurry vortex therein.

2. The mixing circuit as set forth in claim 1 wherein:

the means for introducing heated fresh water is adapted to feed it tangentially to the inner surface of the mixer vessel wall.

3. The mixing circuit as set forth in claim 1 wherein:

a pipeline interconnects the upper end of the mixing chamber with the holding vessel for draining overflow from the former to the latter.

4. The mixing circuit as set forth in claim 1 wherein:

the means for introducing fresh water is adapted to feed it tangentially to the inner surface of the mixer vessel wall; and a pipeline interconnects the upper end of the mixing chamber with the holding vessel for draining overflow from the former to the latter.

5. A continuous process for mixing oil sand with water to produce a slurry, comprising:

introducing a stream of recycled slurry into a circular mixing chamber formed by an open-topped mixer vessel, so that the stream tangentially contacts the inner surface of the mixer vessel wall and forms a swirling vortex comprising a body of slurry and a central air core;

adding fresh water to the vortex;

feeding a free-falling stream of oil sand into the upper part of the vortex, whereby the oil sand, fresh water and recycled slurry mix to form a slurry;

removing the so-produced slurry through a central outlet at the base of the mixing chamber;

screening the slurry leaving the central outlet to remove oversize solids;

collecting the slurry leaving the mixer vessel outlet in a holding vessel;

withdrawing a first stream of slurry from the holding vessel and pumping it through a pipe loop communicating with the mixing chamber, to provide the aforesaid stream of recycled slurry; and withdrawing a second stream of slurry from the holding vessel, for conveyance to a pipeline.

6. The process as set forth in claim 5 wherein the rates of oil sand and fresh water addition and the rate of slurry recycle are controlled to produce a slurry containing in the order of 60 percent by weight solids.

7. The process as set forth in claim 6 comprising:

screening the slurry leaving the central outlet of the mixer vessel, as it passes to the holding vessel, to remove oversize solids.

* * * * *